US007905630B2

(12) United States Patent
Dalsgaard

(10) Patent No.: US 7,905,630 B2
(45) **Date of Patent: *Mar. 15, 2011**

(54) INTERCHANGEABLE LIGHT EFFECTS

(75) Inventor: Carsten Dalsgaard, Silkeborg (DK)

(73) Assignee: Martin Professional A/S, Aarhus N (DK)

( * ) Notice: Subject to any disclaimer, the term of this patent is extended or adjusted under 35 U.S.C. 154(b) by 0 days.

This patent is subject to a terminal disclaimer.

(21) Appl. No.: 12/767,941

(22) Filed: Apr. 27, 2010

(65) Prior Publication Data

US 2010/0208464 A1 Aug. 19, 2010

Related U.S. Application Data

(63) Continuation of application No. 12/058,138, filed on Mar. 28, 2008, now Pat. No. 7,703,948.

(30) Foreign Application Priority Data

Nov. 8, 2007 (DK) ..... 2007 01577

(51) Int. Cl.
*F21V 17/00* (2006.01)

(52) U.S. Cl. ..... 362/281; 362/280; 362/396

(58) Field of Classification Search ..... 362/277, 362/280, 281, 282, 283, 284, 293, 319, 322, 362/323, 324, 396; 359/813, 814, 889, 892
See application file for complete search history.

(56) References Cited

U.S. PATENT DOCUMENTS

| | | | |
|---|---|---|---|
| 4,392,187 | A | 7/1983 | Bornhorst |
| 4,460,943 | A | 7/1984 | Callahan |
| 4,891,738 | A | 1/1990 | Richardson et al. |
| 5,258,895 | A | 11/1993 | Bosse |
| 5,402,326 | A | 3/1995 | Belliveau |
| 5,544,031 | A | 8/1996 | Blanton |
| 6,350,042 | B1 | 2/2002 | Lai |
| 6,601,973 | B2 | 8/2003 | Rasmussen et al. |
| 6,776,508 | B2 | 8/2004 | Bucher et al. |
| 2007/0211475 | A1 | 9/2007 | Sevack et al. |

FOREIGN PATENT DOCUMENTS

| | | | |
|---|---|---|---|
| DE | 195 20 502 | A1 | 12/1996 |
| EP | 1 462 713 | A2 | 9/2004 |
| WO | 2004/031825 | A1 | 4/2004 |
| WO | 2004/046607 | A1 | 6/2004 |

*Primary Examiner* — Y My Quach Lee

(74) *Attorney, Agent, or Firm* — Roberts Mlotkowski Safran & Cole, P.C.; David S. Safran

(57) ABSTRACT

A light effect system includes a light source and at least one aperture element interposed between the light source and an exit lens of the system. The aperture element has at least one aperture and at least one light effect element positioned therein. The system uses an aperture element having at least two "fingers" partly surrounding each light effect element in at least 180° of the circumference. These "fingers" engage with the contour of the outer surface of the light effect element to hold the light effect element in position in the aperture, and the fingers are formed of a flexible material. Hereby, it is achieved that the locking and releasing of the light effect component can be done by push and pull in an ideal perpendicular direction to the light path. In other words, no angling, bending or twisting is necessary, so a minimum of space is required.

8 Claims, 8 Drawing Sheets

459
468
466
464
462
460
458
460
454
456
470
452
450

418
412
410
416
420
414
424
416
408
406
402
404

INTERCHANGEABLE LIGHT EFFECTS

CROSS REFERENCE TO RELATED APPLICATION

This application is a continuation of commonly owned, co-pending U.S. patent application Ser. No. 12/058,138, filed Mar. 28, 2008.

BACKGROUND OF THE INVENTION

1. Field of the Invention

The present invention relates to a light effect system comprising at least one light source, which light source generates a beam of light, which beam of light is passing through a lens system which light effect system comprises at least one aperture element which aperture element comprises at least one aperture, which aperture comprises at least one light effect component.

2. Description of Related Art

The present invention further relates to a method for interchanging light effect elements in a lighting fixture, in which lighting fixture a beam of light is generated by a light source, which beam of light is passing through a lens system where the light beam is further passing through a light effect element which light effect element is placed in an aperture.

The present invention relates to automated lighting systems for use in entertainment, promotional, and architectural applications. Particularly, the invention relates to a system in e.g., a luminaire or projector where different optical components can easily be interchanged without using tools and without taking up space in the longitudinal direction.

As general background, a description of an exemplary projector of the art is provided below. However, as may be appreciated, projectors in accordance with the invention include various other components and configurations. A projector of the prior art usually includes a light beam that emanates from a light source and a reflector at a first end of the projector. The beam passes through color filters before reaching gobo wheel of the projector. The gobo wheel is generally a single, drivingly rotatable wheel having multiple patterns etched therein and distributed about its outer periphery. In some projectors, a motor operated iris increases or decreases beam size before the beam encounters a motor operated effects wheel, which includes appropriate inserts mounted in peripherally distributed window apertures for creating desired modifying effects on the beam, such as altering beam pattern, color or diffusion, creating a prismatic effect, and the like. Finally, the projector may pass the light beam through one or more lenses for providing a zoom effect and for adjusting beam focus and/or divergence prior to exiting the projector housing. Components like gobos, color filters and prismatic lenses are in the following described as "optical components"

Conventional projectors for stage, theater, architectural, and display illumination include means for removably inserting various types of optical beam modifiers into the path of a light beam to vary the color, intensity, size, shape, and pattern of the beam. Thus, in a typical system, a light source produces white light which is passed, for example, through at least one color filter wheel for producing a colored light beam, a gobo wheel for imposing a selected pattern on the light beam, a light intensity wheel for varying the intensity of the light transmitted there through, a mechanical iris for determining beam size, and a lens system for controlling light beam focus and divergence. U.S. Pat. No. 4,392,187 to Bornhorst discloses several such systems. For imposing a desired pattern on the light beam, it is well known to pass the beam through a gobo, which is a template or a light stencil having a predetermined pattern. Typically, gobos are formed by chemically etching the desired pattern onto stainless steel discs. The gobos discs are usually supported in the projected light beam to impose upon the light passing there through the pattern which has been etched into the discs.

It is well known, for example from U.S. Pat. No. 4,460,943 to Callahan, to provide a mounting plate having a plurality of equally spaced apertures arranged around a common axis for mounting gobos within one or more of the apertures. The plate is drivingly rotatable, such as via a motor, about its axis to insert a selected gobo into the path of the beam of light.

U.S. Pat. No. 4,891,738 to Richardson discloses a similar arrangement including an apertured gobo mounting plate which is rotatably driven by motor driven rollers frictionally engaging the peripheral edge of the plate. The gobos are mounted on or within holders which, in turn, are fixedly positioned within the plate apertures. The mounting plate is rotatably driven to position a selected gobo within the beam of light. After reaching this position, a motor-operated holder drive mechanism acts, through frictional contact with the rim of the holder, to rotatably drive the gobo holder in either direction at various speeds. In this manner, the plate is rotatable to position a selected gobo within the beam of light, and the gobo holder is rotatable to spin the gobo holder within the beam of light. Generally, the projectors are constructed in a compact fashion because the rotational inertia of the projector increases the speed at which the beam of light can be moved into position. Furthermore, in an optical system, there will always be a limited room for focusing. This means that the optical components like gobos, which are supposed to be projected, only have very limited room, and it is crucial to have as many optical components in this area as possible in order to have the most interesting product. This compact design leads to various disadvantages in the maintenance and upkeep of the projectors. Furthermore, the compact design of the projectors hinders the replacement of gobos in the projector.

For example, U.S. Pat. No. 5,402,326 to Belliveau discloses a gobo carousel that contains a number of gobo holders. The carousel is rotatable to position a desired gobo within the light path and further includes means for rotating the holders in relation to the carousel itself. The holders are permanently attached to the carousel and include a mechanism for securely retaining and for replacing gobos from within the holders. However, due to the compact design of the light projector, such gobo carousels, as well as the gobo holders, are often mounted in close proximity to adjacent mechanical parts. Accordingly, replacing the gobos in the gobo holders can be very awkward.

This is in many aspects solved in U.S. Pat. No. 6,601,973 to Rasmussen which discloses an interchangeable gobo wheel assembly including a plurality of apertures and gobo holders containing gobos. The gobo wheel is adapted to rotate so as to place a gobo, which is retained in one of the holders, within the light path from the light source. The gobo holders of the gobo wheel are removably secured to the gobo wheel by a spring retainer that engages flange portions of a gobo holder. This system has the disadvantage that the optical element (here a gobo in a gobo holder) has to be slightly angled to be released from its position, and this open space may not be an option in compact lighting fixture designs.

Therefore, there is need for a system that enables easy exchange of optical components (e.g., gobos) in such compactly constructed projector without the need of reserving space in the longitudinal direction in the fixture.

SUMMARY OF THE INVENTION

The object of this invention is to make a very simple and compact light effect system that enhances the possibility of making a compact lighting fixture. This invention facilitates the interchange of optical components without taking up space in the longitudinal direction of the fixture, without using tools and without touching any other components than the optical component itself Furthermore, this invention is simple to manufacture and assemble and therefore highly cost-effective.

The object can be achieved by a light effect system having at least one light source, which light source generates a beam of light, which beam of light is passing through a lens system which light effect system comprises at least one plate-shaped aperture element which plate-shaped aperture element comprises at least one aperture, which plate-shaped aperture element comprises at least one light effect element, if further modified by using the aperture element as the locking part, where the aperture element is designed with snapping "fingers" made in a flexible material (e.g., spring steel), which partly surround each light effect element in at least 180° of the circumference. These snapping "fingers" engage with the outer contour of the light effect component and hold the light effect element in position in the aperture opening.

Hereby, it is achieved that the locking and releasing of the light effect component can be done with push and pull in an ideal perpendicular direction to the light path (longitudinal direction in the fixture). In other words, no angling, bending or twisting is necessary, so a minimum of space is required. The snapping function in the system is achieved because of the surrounding of minimum 180° of the circumference of a gobo and the fact that the fingers are designed and made of a material that will not make a permanent deformation when the light effect element is pushed in and pulled out.

If the light effect element further comprises a groove, and the "fingers" are just a thin plate, the parts will also lock mechanically and not only by the prestressed state that the fingers can apply.

The opposite situation, where the fingers comprise a groove and the light effect element a flange will provide the same result.

The light effect element could be an assembly comprising several components e.g., a bearing. A bearing gives the opportunity to rotate the inner part in relation to the outer part, thus adding more optical features to the light effect system if the optical components are attached to the rotating part. Adding teeth to the rotatable part provides the possibility of driving the light effect element with e.g., a stepper motor with a driving gear. The outer part of the bearing is designed with a groove to accomplish the locking function as previously described.

If the grooves are moved to the fingers and the flange to the outer surface of the bearing, the same functionality would be provided.

So far, it has not been specified how the light effect elements are positioned. One embodiment could be that they are positioned in a circle around a rotating center (a wheel). This center is positioned in a distance to the optical path corresponding to the radius of the circle in which the light effect elements are positioned. In this way, it is possible to change from one optical element to another, either manually or more preferably by a motor when the wheel is rotated. Furthermore, a sun gear independently rotatable in relation to the wheel (aperture element) and engaging the toothed flanges on the light effect elements will add the feature of rotating the optical components e.g. a gobo. The sun gear could be driven by a stepper motor.

Instead of positioning the light effect elements in a circle (on a wheel), they could be positioned in a straight line e.g., a cassette. The advantage of this is that the system takes up little space in one plane, but unfortunately it takes up much space in the other plane. In other words, the circumscribed circle of a system with identical numbers of equal light effect components will be larger in a linear system than in a circular system.

In a possible embodiment of the invention, the fingers can be engaged with the outer contour of the light effect element in: three positions, which positions are spread in at least 108 degrees of the circumference of the light effect element. Herby, it can be achieved that an interaction between fingers and optical can lock the position of the optical element, and that the optical element can only be placed in one rotational position. This can be important for all light effects having a specific orientation. Also for rotating light effects, the angular position of the light effect is important for computer-based operation of a number of light effect systems maybe showing the same effect rotating synchronously in a light show.

In another possible embodiment of the invention, the fingers can be formed of a wire folded into the form of the fingers, which fingers partly surround each light effect element in at least 180° of the circumference. Hereby, it can be achieved, that an elastic spring is used for locking the optical element.

In several of the previously described embodiments of the invention, a light blocking element with an aperture is placed over the fingers for blocking light passing around the light effect element.

DETAILED DESCRIPTION OF THE INVENTION

Figure 1:
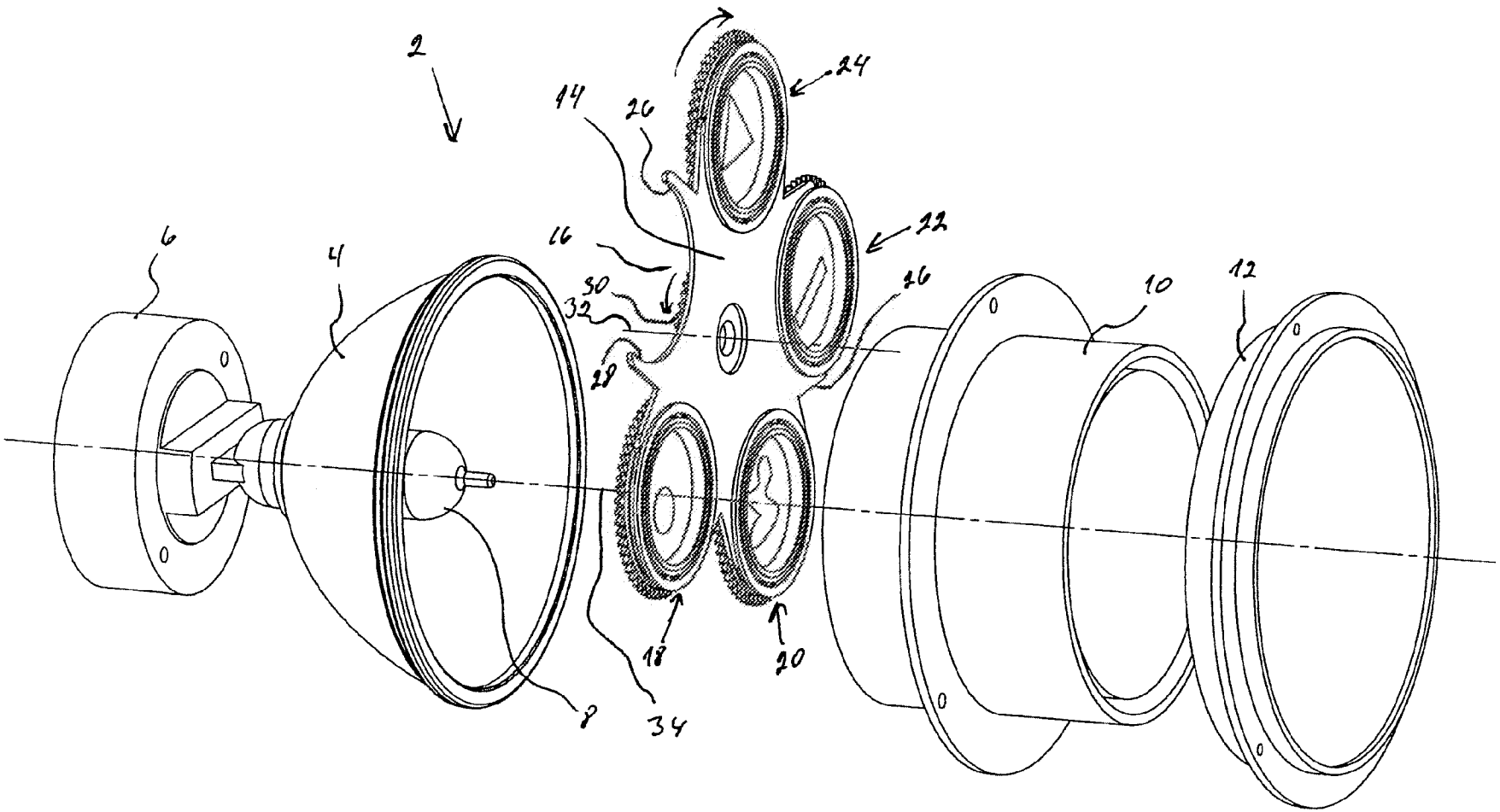
FIG. 1 illustrates a simplified optical system (rotating effect)

FIG. 1 illustrates a simplified optical system (2) comprising: lamp socket (6), light source (8), reflector (4), an aperture element (gobo wheel) (14) comprising different interchangeable light effect elements (gobos) (18-24), a first lens group (10) and a front lens (12). All these elements are positioned along an optical axis (34). The aperture element (gobo wheel) (14) further comprises a number of apertures (16) and flexible fingers (26, 28). A center sun gear (30) is rotatably connected to the same center (32) as the aperture element (14).

In operation, the lamp source (8) emits light which is partly collected by the reflector (4) and radiated through the gobo (18) along the optical axis (34). The lens system (10, 12) is positioned in order to make an image of this gobo (18), and the passing light beam projects an image of the selected gobo (18) in a certain distance from the front lens. The gobo wheel (14) is rotatable around an axis (32) which makes it possible to change between the different gobos (18-24). The rotation could be driven by a stepper motor (not illustrated). One aperture (16) is left open because it is not necessarily preferred to have an optical effect in the optical path (34). Every light effect element (18-24) includes a bearing (the assembly is described later in FIGS. 7 and 8). The outer part of the bearing comprises a groove which engages with the fingers (26, 28). The inner part of the bearing freely rotates together with a toothed flange which engages with the center sun gear (30), which is preferably driven by e.g. a second stepper motor (not illustrated). This toothed flange engages with an optical element. In this embodiment of the invention they are glued together, but they could preferable engage mechanically by e.g. spring retainers. When this feature is activated, the image will rotate. The light effect elements (18-24) can be released from their positions (see FIG. 9), by simply pulling the elements in exactly the same plane as the aperture element. No twisting or bending is necessary, and a very limited space is needed. The tension and friction from the flexible fingers (26, 28) are the forces that have to be overcome. The design of the fingers (26, 28) is a mix of several parameters: thickness, material, length, surface (friction) and angle surrounding (at least 180°). The at least 180° surrounding is crucial to the invention. When the surrounding is more than 180°, the opening between the fingers (26, 28) will be smaller than the diameter of the bottom of the groove. The difference between these two distances is the distance that the flexible fingers (26, 28) have to be resilient when sliding the light effect elements (18-24) in and out. The design is to ensure the following:

1. The mass of the light effect element (18-24) may prevent the elements from releasing during transportation and use of the system when the elements are affected by gravity and other accelerations.
2. The force needed to pull and push the light effect elements (18-24) in and out of the aperture (16) should not be more than what an average adult is able to provide with two fingers and no tools.
3. The fingers must never be stressed to an extent, where the material will make a permanent deformation.

Although circular in all illustrations, the optical components or optical elements (18-24) are not limited to be completely circular in shape. If a special orientation is needed, the shape could be designed to lock in a certain position.

Figure 2:
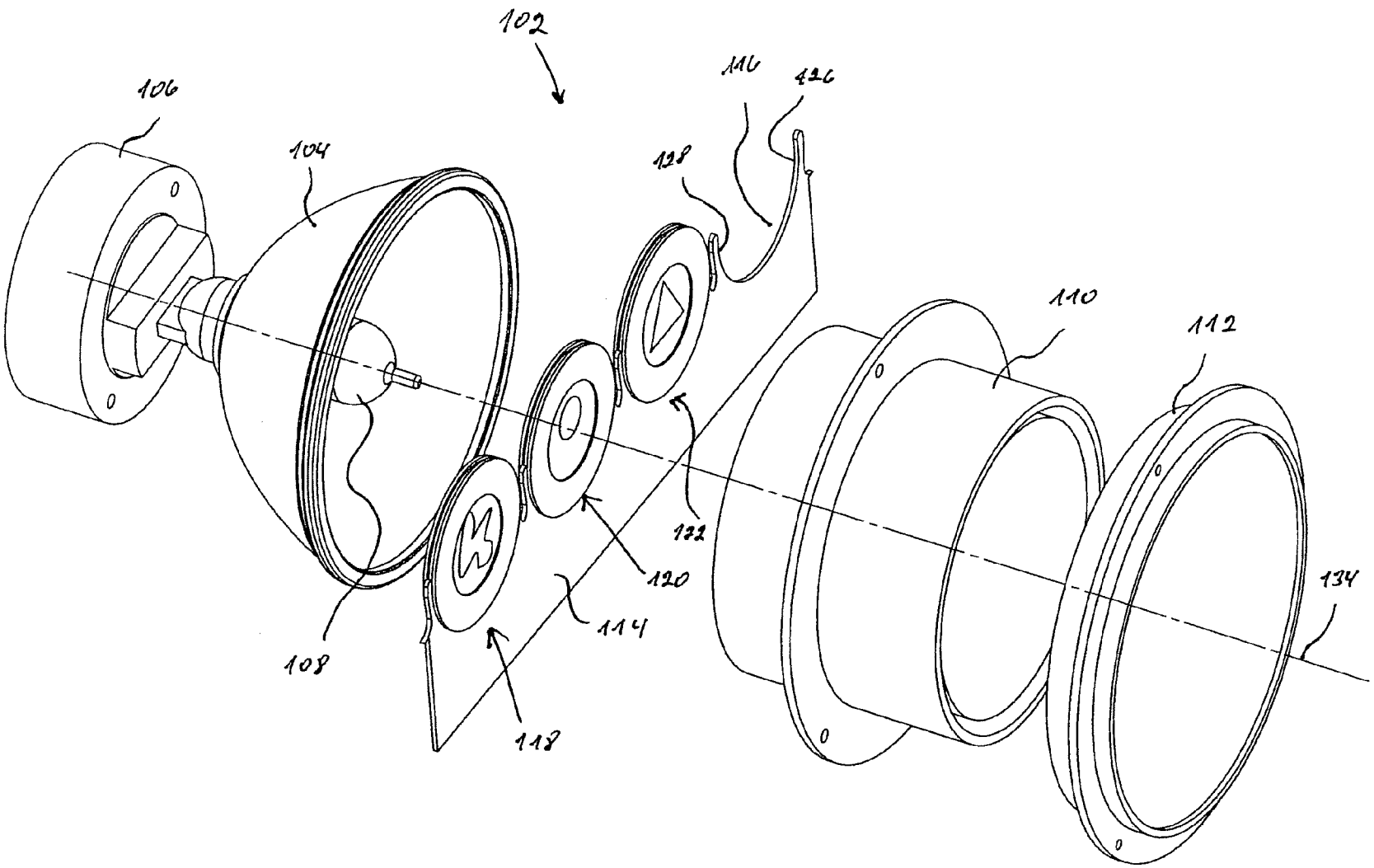
FIG. 2 illustrates a simplified optical system (linear effect)

FIG. 2 illustrates another embodiment of the invention, but most of the content is similar to the embodiment previously described in FIG. 1. Any divergence will be described in the following.

Instead of a gobo wheel, a linear aperture element (114) is added to the light effect system (102), and even though possible, no rotation is included in this embodiment of the invention. The linear aperture element (114) is linearly movable in a direction perpendicular to the optical axis (134) in order to change between the different light effect elements (gobos) (118-124). The movement can preferably be done by a stepper motor and a linear guide (not illustrated)

Figure 3:
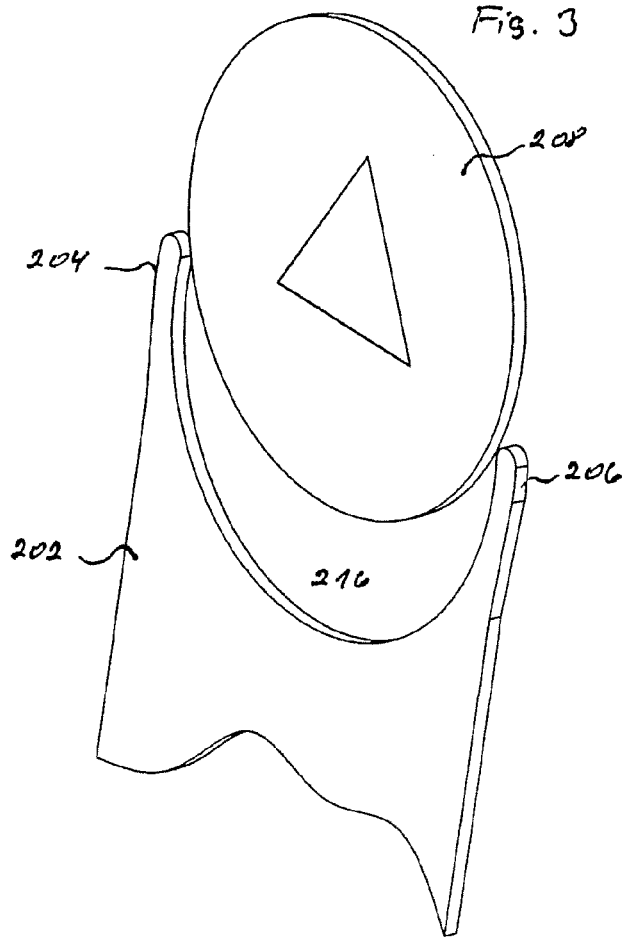
FIG. 3 illustrates a section of the simplest embodiment of the invention in released position

FIG. 3 illustrates a section of the simplest embodiment of the invention in released position. The optical component, a gobo (208), is only locked in one direction by the fingers (204,206), which may not be sufficient in many applications.

Figure 4:
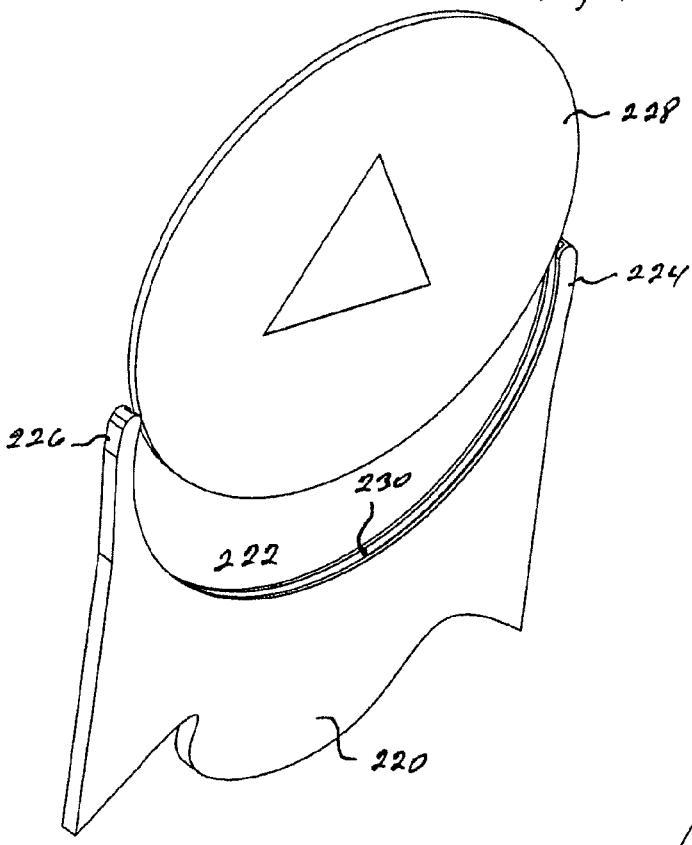
FIG. 4 illustrates a section of a more useable embodiment of the invention in released position

FIG. 4 illustrates a section of a more useable embodiment of the invention in released position. Notice that the section of the aperture element (220) comprises a groove (230), which will engage securely with the optical component (228) to be locked in all directions. This embodiment is very useful in connection with color filters or fixed gobos. The fingers (224, 226) could preferably be molded in a silicone compound to avoid any damage of glass structure filters. The molding should be done on top of a more stiff material like aluminum or steel to ensure the rigidity of the aperture element (220).

Figure 5:
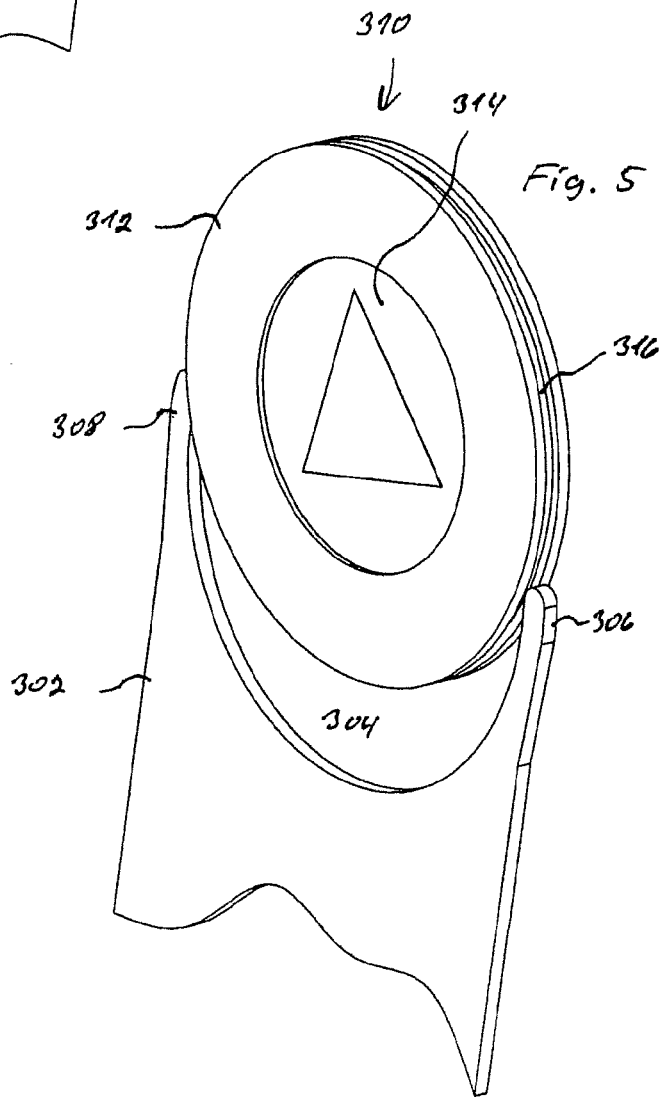
FIG. 5 illustrates a section of another embodiment of the invention in released position

FIG. 5 illustrates a section of another embodiment of the invention in released position.

An optical assembly (310) is added. This assembly (314) comprises an optical component adapter (312) which comprises a groove (316).The gobo (314) is secured in the adapter (312) by glue, but this could also have been done mechanically by retainers as described in prior art. This embodiment is preferred when the optical components (314) are fragile and need to be protected from scratches or touching.

Figure 6:
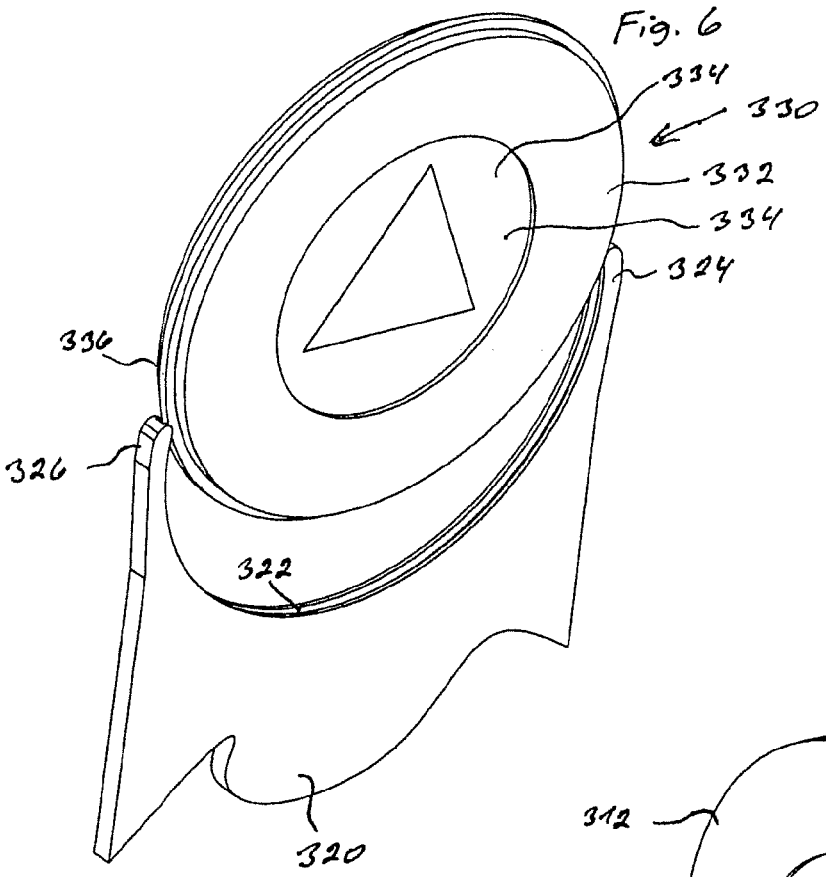
FIG. 6 illustrates a section of a "mirrored" embodiment of the invention described in FIG. 5

FIG. 6 illustrates a section of a "mirrored" embodiment of the invention described in FIG. 5. This embodiment has the same effect. The only differences are that the aperture element (320) comprises the groove (338), and the optical assembly (330) comprises the flange (336) to engage with this groove (338).

Figure 7:
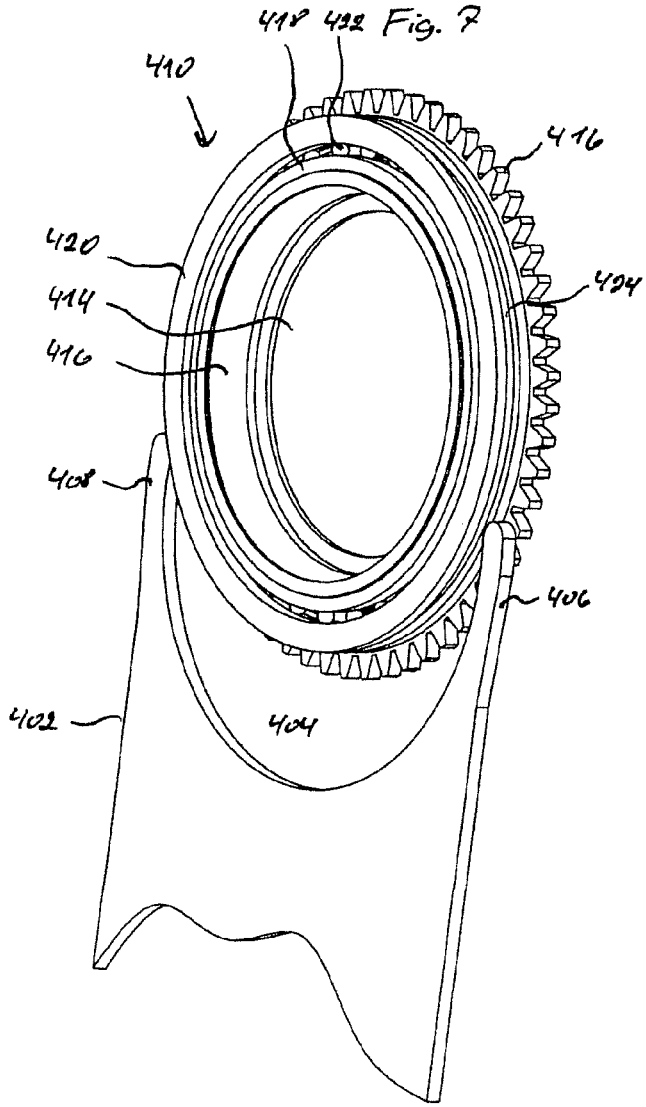
FIG. 7 illustrates a section of the embodiment described in FIG. 1 but in released position

FIG. 7 illustrates a section of the embodiment described in FIG. 1 but in released position. A section of an aperture element (402) comprises an aperture (404) and fingers (406, 408). A released optical assembly (410) comprising a ball bearing (inner bearing element 418, outer bearing element 420, balls 422). The inner bearing element (418) is mechanically locked with a toothed guide and a rotating flange (416) wherein an optical component (414) is secured with e.g., high temperature silicone glue. The outer bearing element (420) comprises a groove (424) to engage with the flexible fingers (406, 408) when pushed into the locked position where the aperture (404) is concentric with the groove (424). The optical component (414) can then rotate: in relation to the aperture element (402), e.g., driven by a sun gear as described in FIGS. 1 & 9. This embodiment of the invention is very easy to manufacture.

Figure 8:
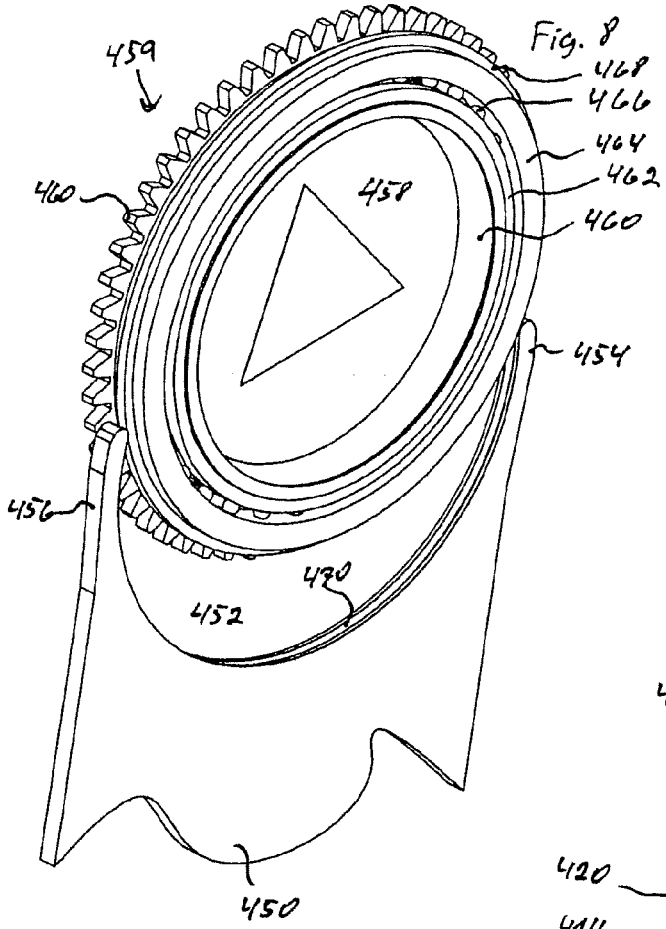
FIG. 8 illustrates a section of a "mirrored" embodiment of the invention described in FIG. 7

FIG. 8 illustrates a section of a "mirrored" embodiment of the invention described in FIG. 7. This embodiment has the same effect. The only differences are that the aperture element (450) comprises the groove (470), and the optical assembly (459) comprises the flange (468) to engage with this groove (470).

Figure 9:
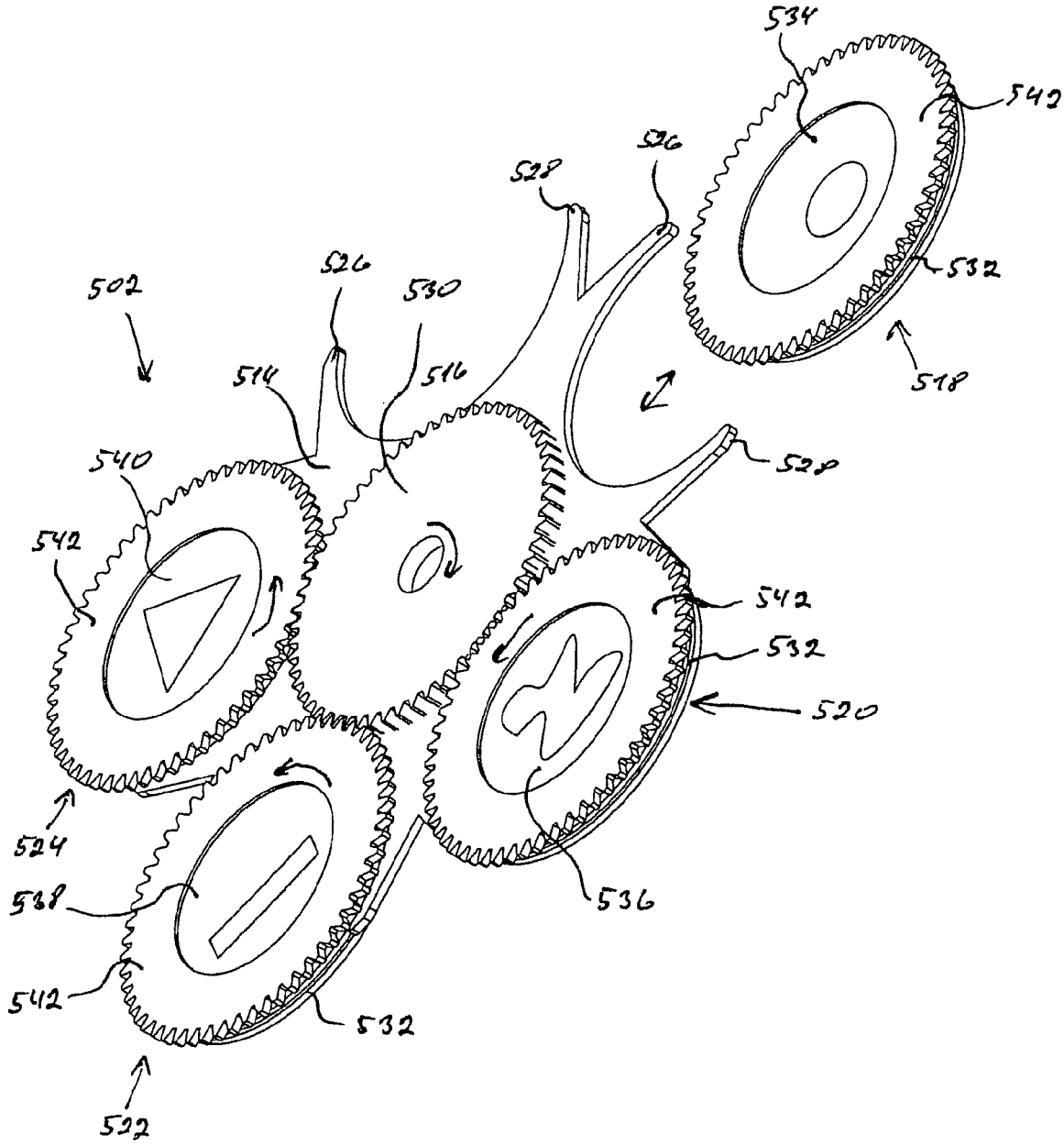
FIG. 9 illustrates a light effect wheel as described in FIG. 1 and in section in FIG. 7

FIG. 9 illustrates a light effect wheel (502) described in FIG. 1 and in section in FIG. 7.

The light effect wheel (502) comprises previously described elements but it illustrates very clearly what is meant by a sun gear system. A center sun gear (530) is rotatable engaging the toothed "planets" (518-524, here the light effect elements). A released light effect element (518) is also illustrated.

Figure 10:
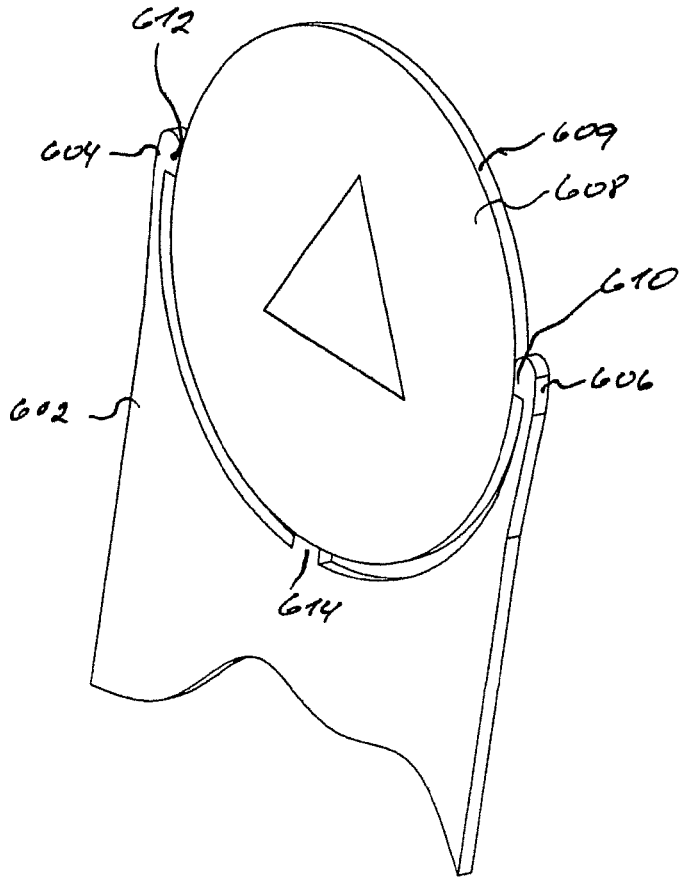
FIG. 10 shows a section of an aperture element

FIG. 10 shows a section of an aperture element 602 comprising fingers 604, 606, which fingers 604, 606 are holding an optical component 608, comprising a groove 609 interaction with three protrusions 610, 612, 614 for holding the light effect element in position.

Figure 11:
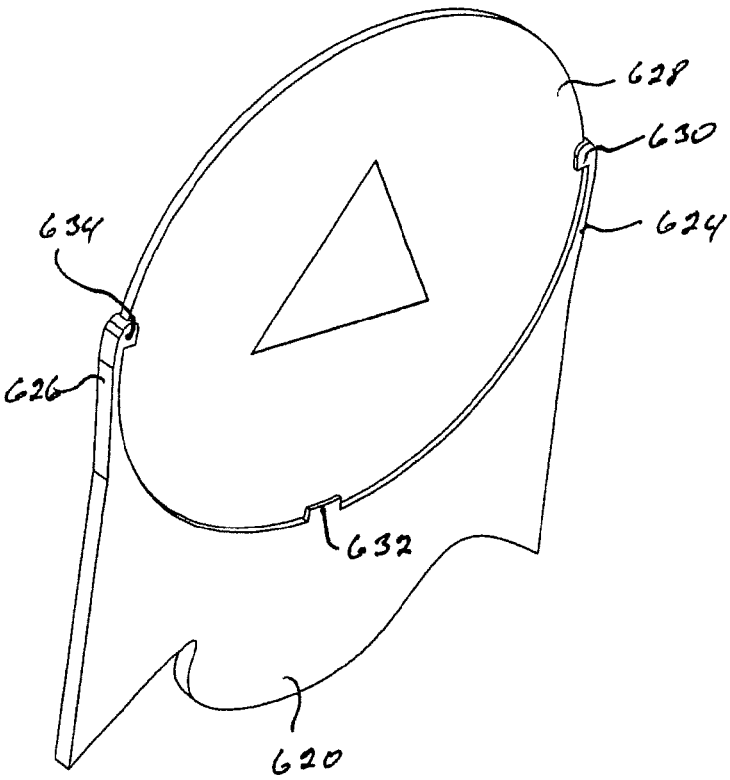
FIG. 11 shows a section of an aperture element

FIG. 11 shows a section of an aperture element 620 comprising fingers 624, 626 for holding optical component 628, where the fingers comprise protrusions 630, 632, 634, which protrusions are formed with a recess between them for holding the optical component 628.

Figure 12:
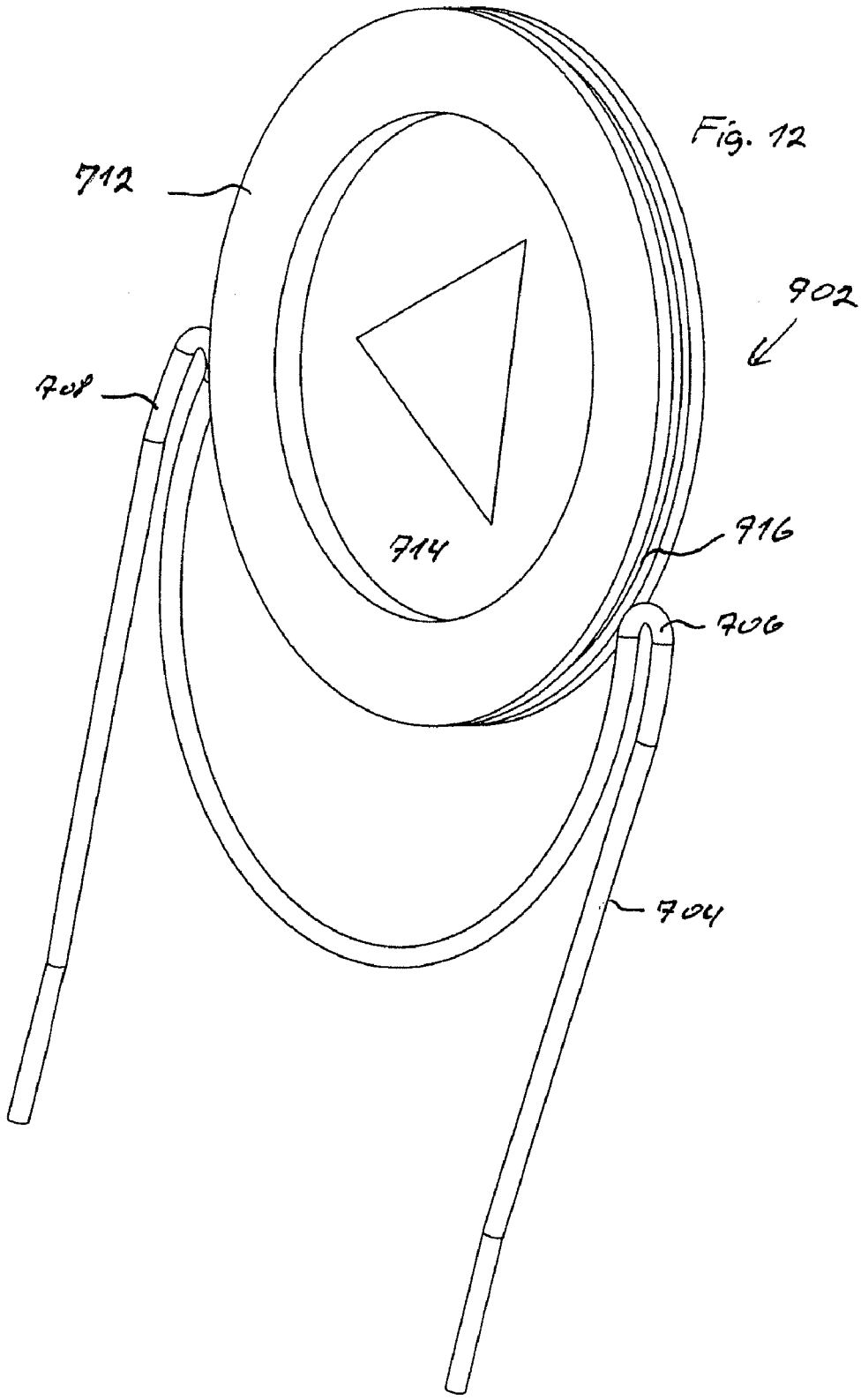
FIG. 12 shows a section of an aperture element.

FIG. 12 shows a section of an aperture element 702 formed of a spring element 604 forming fingers 706, 708 for holding optical component adapter 712.

What is claimed is:

1. A light effect system comprising:

at least one light source, which light source generates a beam of light along an optical axis through a lens system, at least one light effect element, and at least one plate-shaped aperture element that is positioned perpendicular to said optical axis and has at least one aperture through which said beam of light may pass, each aperture being defined by at least two fingers which partially surround and support a respective light effect element in at least 180° of the circumference, wherein said fingers are formed of a flexible material and wherein said fingers engage with the contour of an outer surface of the light effect element and hold the light effect element in position in the aperture by themselves so that the light effect element is able to be mounted and detached from within the aperture simply by being pushed in and pulled out, respectively, from between the fingers of a spring element in a direction that is perpendicular to said optical axis.

2. The light effect system according to claim 1, wherein a number of said plate-shaped aperture elements are positioned in a circle around a rotating center.

3. The light effect system of claim 2, wherein each light effect element comprises a bearing assembly, the said bearing assembly comprising an outer element relatively engaging with the fingers and an inner rotatable element comprising means for attachment of optical components and comprising a toothed flange.

4. The light effect system according to claim 3, wherein light effect elements are positioned in a circle around the rotating center, the said center comprising a sun gear independently rotatable from the aperture element, and the said center sun gear engaging the said toothed flanges.

5. The light effect system of claim 4, wherein the light effect element comprises a groove for accommodating the fingers.

6. The light effect system of claim 4, wherein the fingers comprise a groove, the said groove accommodating a flange on the light effect element.

7. The light effect system according to claim 1, wherein a number of said plate-shaped aperture elements and the light effect elements are positioned in a straight line.

8. The light effect system according to claim 1, where the fingers are engaged with the outer contour of the light effect element in three positions, which positions are spread in at least 180 degrees of the circumference of the light effect element.

* * * * *